US006264885B1

(12) United States Patent
Knickerbocker et al.

(10) Patent No.: US 6,264,885 B1
(45) **Date of Patent: *Jul. 24, 2001**

(54) METAL/FERRITE LAMINATE MAGNET

(75) Inventors: John Ulrich Knickerbocker, Hopewell Junction, NY (US); Andrew Ramsay Knox, Kilbirnie (GB); Robert Rosenberg, Peekskill, NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/377,987

(22) Filed: Aug. 18, 1999

Related U.S. Application Data

(62) Division of application No. 08/854,285, filed on May 9, 1997, now Pat. No. 5,986,395.

(51) Int. Cl.[7] ..... B22F 7/04
(52) U.S. Cl. ..... 419/8; 419/26; 419/38
(58) Field of Search ..... 419/8, 38, 26

(56) References Cited

U.S. PATENT DOCUMENTS 4,023,057 5/1977 Meckling .
4,138,236 2/1979 Harberey .
4,471,262 9/1984 Tamura et al. .
4,540,500 9/1985 Torii et al. .
4,835,438 5/1989 Baptist et al. .
5,763,987 9/1998 Mokikawa et al. .
5,857,883 * 1/1999 Knickerbocker et al. ..... 445/23

FOREIGN PATENT DOCUMENTS 2303981 3/1997 (GB) .

OTHER PUBLICATIONS

Patent Abstracts of Japan, Publication No. JP60093742, vol.: 9, No.: 240, Patentee: Matsushita Denki Sangyo KK, entitled "Display Device".

* cited by examiner

*Primary Examiner*—Daniel Jenkins
(74) *Attorney, Agent, or Firm*—Margaret A. Pepper

(57) ABSTRACT

A metal/ferrite laminate magnet has perforations forming apertures in the magnet. The magnet is formed of outside metal plates surrounding a sandwich of two layers of ferrite material. The outside metal plates allow the perforations to be made in the magnet before sintering of the magnet and maintain the alignment of the holes during sintering. The metal plates also provide the magnet with mechanical robustness and rigidity and prevent cracking occurring between adjacent apertures.

29 Claims, 3 Drawing Sheets

METAL/FERRITE LAMINATE MAGNET

CROSS-REFERENCE TO RELATED PATENT APPLICATION

This Patent Application is a Divisional Patent Application of U.S. patent application Ser. No. 08/854,285, filed on May 9, 1997, which issued as U.S. Pat. No. 5,986,395, on Nov. 16, 1999.

FIELD OF THE INVENTION

The present invention relates to a metal/ferrite laminate magnet having perforations and in particular to a magnet having a metal plate attached to a ferrite to maintain positional accuracy of perforations in the laminate.

BACKGROUND OF THE INVENTION

A magnetic matrix display is particularly although not exclusively useful in flat panel display applications such as television receivers and visual display units for computers, especially although not exclusively portable and/or desktop computers, personal organisers, communications equipment, and, the like.

Conventional flat panel displays, such as liquid crystal display panels and field emission displays, are complicated to manufacture because they each involve a relatively high level of semiconductor fabrication, delicate materials, and high tolerances.

UK Patent Application No. 2304981 discloses a magnetic matrix display having a cathode for emitting electrons, a permanent magnet with a two dimensional array of channels extending between opposite poles of the magnet, the direction of magnetisation being from the surface facing the cathode to the opposing surface. The magnet generates, in each channel, a magnetic field for directing electrons from the cathode means into an electron beam. The display also has a screen for receiving the electron beam from each channel. The screen has a phosphor coating facing the side of the magnet remote from the cathode, the phosphor coating comprising a plurality of pixels each corresponding to a different channel. There are grid electrode means disposed between the cathode means and the magnet for controlling the flow of electrons from the cathode means into each channel. The two dimensional array of channels are regularly spaced on an X-Y grid. The magnet area is large compared with its thickness.

The permanent magnet is used to form substantially linear, high intensity fields in the channels or magnetic apertures for the purpose of collimating the electrons passing through the aperture. The permanent magnet is insulating, or at most, has a small conductivity, so as to allow a field gradient along the length of the aperture. The placement of the beam so formed, on the phosphor coating, is largely dependent on the physical location of the apertures in the permanent magnet.

In operation, these electron beams are directed at a phosphor screen and collision of the electron beam with the phosphor results in light output, the intensity being proportional to the incident beam current (for a fixed final anode voltage). For color displays, three different colored phosphors (such as red, green and blue) are used and color is obtained by selective mixing of these three primary colors.

For accurate color reproduction, the location of the electron beams on the appropriate colored phosphor is essential.

Some degree of error may be tolerated by using "black matrix" to separate the different phosphors. This material acts to delimit individual phosphor colors and also enhances the contrast ratio of the displayed image by making the display faceplate appear darker. However, if the electron beam is misplaced relative to the phosphor, initially the light output from the phosphor is reduced (due to loss of beam current to the black matrix) and this will be visible as a luminance non-uniformity. If the beam is subject to a more severe placement error, it may stray onto a different colored phosphor to that for which it was intended and start to produce visible quantities of light output. Thus the misplaced electron beam is actually producing the wrong light output color. This is called a purity error and is a most undesirable display artifact. For a 0.3 mm pixel, typical phosphor widths are 67 $\mu$m with 33 $\mu$m black matrix between them.

It will be apparent that a very precise alignment is required between the magnet used to form the electron beams and the glass plate used to carry the phosphors that receive the electron beams. Further, this precise alignment must be maintained over a range of different operating conditions (high and low brightness, variable ambient temperature etc).

A number of other magnet characteristics are also important when considering application for a display, such as, for example:

1. It is generally accepted that the displayed image is formed by a regular array of pixels. These pixels are conventionally placed on a square or rectangular grid. In order to retain compatibility with graphics adaptors the magnet must thus present the electron beams on such an array.
2. In operation, the spacing between the grids used for bias and modulation of the electron beam and the electron source determines the current carried in the electron beam. Variations of this spacing will lead to variations in beam current and so to changes in light output from the phosphor screen. Hence it is a requirement that the magnet, which is used as a carrier for these bias and modulation grids, maintain a known spacing to the electron source. To avoid constructional difficulties, the magnet should be flat.
3. The display will be subject to mechanical forces, especially during shipment. The magnet must retain structural integrity over the allowable range of stresses it may encounter. A commonly accepted level is an equivalent acceleration of 30 G (294 $ms^{-2}$).

One further requirement is that since the magnet is to be used within the display, which is evacuated, it should not contain any organic components which may be released over the life of the display, so degrading the quality of vacuum or poisoning the cathode.

Finally, the magnet is magnetized in the direction of the apertures, that is the poles correspond to the faces of the magnet.

The manufacture of such a magnet that satisfies the above conditions is not possible by the use of previously known manufacturing methods. Certainly a magnet (ferrite, for example) of the desired size without apertures is readily obtainable but the presence of the apertures causes some problems.

If the apertures in the magnet are to be formed after the ferrite plate has been sintered, either laser or mechanical drilling may be used. However, the sintered ferrite is a very hard material and forming the apertures by this technique will be a costly and lengthy process—unsuitable for a manufacturing process.

Holes could be formed in the ferrite at the green-sheet stage before sintering by known punching/drilling methods typical of multi-layer ceramics for microelectronics applications. However, during sintering a number of problems would be anticipated, such as, for example:

1. The magnet plate will be subject to uneven shrinkage leading to the holes "moving"—an unequal radial displacement from their nominal positions.
2. The magnet itself is likely to "bow" such that it forms a section of a large diameter sphere.
3. Cracking is likely to occur between adjacent apertures due to the apertures acting as stress concentrators.
4. If, to obtain the desired aperture length, multiple thin sheets are stacked on top of one another, misalignment may occur in stacking which could lead to no "line of sight" through the apertures.

A further problem is that ferrite is a hard but not tough material and the presence of the apertures significantly reduces the mechanical strength of the plate Thus, during shipment when large shocks may be encountered, complete mechanical failure of the magnet is a distinct possibility.

U.S. Pat. No. 4,138,236 discloses a method of bonding hard and/or soft magnetic ferrite parts with an oxide glass. The oxide glass may be applied prior to or after prefiring or main firing Finally, the ferrite parts are fused at temperatures in excess of the glass softening point.

U.S. Pat. No. 4,540,500 discloses a low temperature sinterable oxide magnetic material prepared by adding 0.1 to 5% by weight of class to ferrite In some situations, the sintering temperature can be reduced to about 1,000° C. or less.

U.S. Pat. No. 4,023,057 discloses a compound magnet for a motor stator having a laminated structure that includes thin, flexible magnets made from permanently magnetizable particles, such as barium ferrite, that are embedded in a flexible matrix, such as rubber. Various laminated arrangements are contemplated for producing more intense magnetic fields and thin metal spacers are used in most laminated structures to collapse the respective fields of the flexible magnetic components to increase the flux density at the resultant poles and to orient the permanent magnetic fields in the magnetic circuit of the motor.

Published Japanese Patent Application No. JP60093742 discloses a display having a focus electrode with a conductive magnetic body and a sputtered metal coating on one surface of the magnet body. The conductivity is required for the focusing electrode to perform its function. The coating is sputtered and so is a thin coating, not substantially adding to the mechanical structure of the magnet. Each of the holes in the magnet has a number of electron beams passing through it.

SUMMARY OF THE INVENTION

It is an object of the present invention to provide magnet apertures which remain precisely aligned with the phosphors under all operating conditions.

It is a further object of the present invention to provide apertures which are formed on a regular array.

It is a further object of the present invention to provide a magnet surface which is flat to maintain the cathode/grid spacing.

It is a yet further object of the present invention to provide a magnet which is able to withstand mechanical shock without damage.

Accordingly the invention provides a metal/ferrite laminate magnet comprising: a first ferrite sheet having a first surface and a second surface; a first metal plate having a first surface and a second surface, the first surface being attached to said first ferrite sheet over substantially the whole of a first surface of said first ferrite sheet; the first metal plate and the first ferrite sheet each having a plurality of apertures formed therein, extending from said first surfaces to said second surfaces, said apertures of said first ferrite sheet and said first metal plate being substantially aligned; a second ferrite sheet having a first surface and a second surface; a second metal plate having a first surface and a second surface, the first surface being attached to said second ferrite sheet over substantially the whole of a first surface of said second ferrite sheet; said second metal plate and said second ferrite sheet each having a plurality of apertures formed therein, extending from said first surfaces to said second surfaces, said apertures of said second ferrite sheet and said second metal plate being substantially aligned; and said first metal plate and said first ferrite sheet being joined to said second metal plate attached to said second ferrite sheet, such that the second surfaces of said first and second ferrite sheets abut and such that said apertures in said first and second ferrite sheets are substantially aligned In a preferred embodiment in which deflection anodes are provided on one of the outer surfaces of the magnet the metal/ferrite laminate magnet further comprises a first insulating layer having a first surface and a second surface, the first surface being attached to said first metal plate, over substantially the whole of the second surface of the first metal plate; a first conductive layer, forming a set of deflection anodes, having a first surface and a second surface, the second surface being attached to said first insulating layer, over substantially the whole of a second surface of the first insulating layer; and said first insulating layer and said first conductive layer each having a plurality of respective apertures formed therein, each of the apertures corresponding to, and aligned with, a respective aperture in the first metal plate In a yet further preferred embodiment in which two sets of control grids are provided on the outer surface of the magnet opposing the deflection anodes the metal/ferrite laminate magnet further comprises: a second insulating layer having a first surface and a second surface, the first surface being attached to said second metal plate, over substantially the whole of the second surface of the second metal plate; a second conductive layer, forming a set of control electrodes, having a first surface and a second surface, the first surface being attached to said second insulating layer, over substantially the whole of the second surface of the second insulating layer; a third insulating layer having a first surface and a second surface, the first surface being attached to said second conductive layer, over substantially the whole of a second surface of the second conductive layer; a third conductive layer, forming a set of control electrodes, having a first surface and a second surface, the first surface being attached to said third insulating layer, over substantially the whole of a first surface of the third insulating layer; and wherein said second insulating layer, said second conductive layer, said third insulating layer and said third conductive layer each have a plurality of respective apertures formed therein, each of the apertures corresponding to, and aligned with, a respective aperture in the second metal plate.

In order to provide substantially linear, high intensity fields in the apertures for the purpose of collimating the electrons passing through the aperture, the first and second ferrite sheets are magnetized in the direction of the apertures so that the first surfaces of the first and second ferrite sheets form the opposing poles of the magnet.

Preferably, the plurality of apertures formed in the metal sheets and the ferrite sheets are arranged as a regular array so as to retain compatibility with existing graphics adapters.

Further preferably, to reduce stresses in the magnet, the thermal expansion coefficient of the ferrite sheets substantially corresponds to that of the metal plates.

In a preferred embodiment of the magnet the metal plates are stainless steel, which is magnetically transparent so as not to disturb the desired flux pattern from the magnet.

In an alternative embodiment, the metal plates are soft iron having high permeability, which has the effect of shunting the magnetic field external to the magnet assembly, so limiting the collimating effect of the magnetic field to the apertures only.

In a further alternative embodiment, the second metal plate is stainless steel and magnetically transparent and the first metal plate is soft iron and shunts the magnetic field external to the magnet assembly. This has the effect of forcing the field lines within the apertures at the end nearest the first metal plate to be normal to the metal plate surface, rather than to bend towards the outer edges of the magnet.

In a yet more preferred embodiment, the ferrite sheet has a bulk electrical resistance of between about $10^7\Omega/\square$ and about $10^9\Omega/\square$. This high, but finite, resistance provides a leakage path for the charge left by electron collisions and positive ion collisions with the aperture walls.

BRIEF DESCRIPTION OF THE DRAWINGS

The invention will now be described, by way of example only, with reference to the accompanying drawings, in which.

DETAILED DESCRIPTION OF THE PREFERRED EMBODIMENTS

Figure 1:
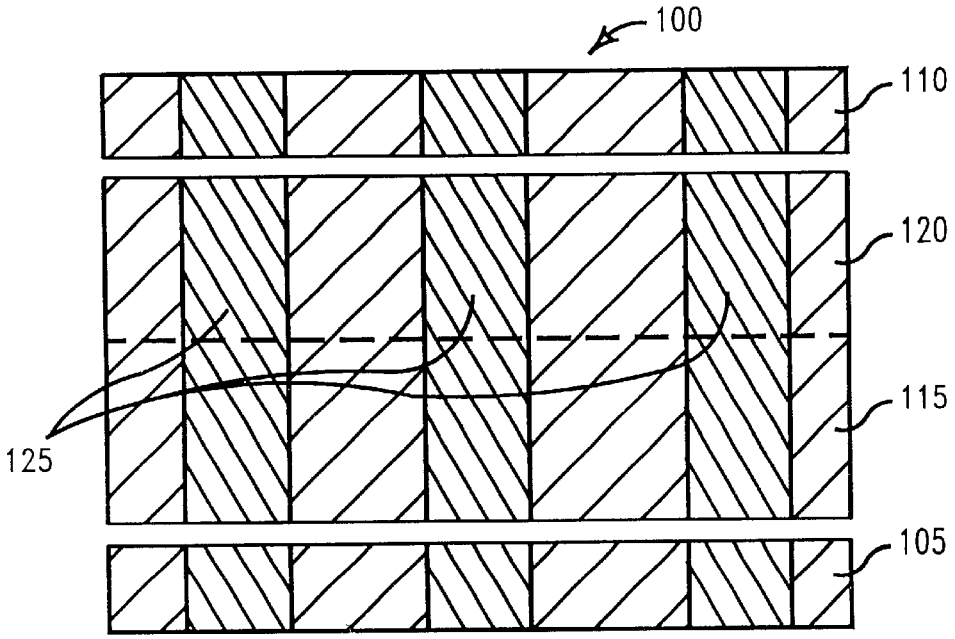
FIG. 1 shows a magnet according to a first embodiment of the present invention having a pair of metal layers with two ferrite sheets therebetween.

FIG. 1 shows a magnet 100 which consists of magnetic material 120,115 built with two metal plates 105,110 sandwiching the magnetic material 120,115 Holes or apertures 125 are formed in the magnetic material layers 120,115 and in the metal plates 105,110. The metal plates 105, 110 may be a magnetically transparent material, such as, for example, stainless steel or they may be a metal with a high permeability, such as, soft iron.

In each of the FIGS. 1 to 5, the layers are shown with a small separation between them for the purposes of clarity, however, the layers are actually substantially in contact with each other without gaps between them.

One process for forming the preferred magnet is:

Step 1—Cut the metal plate 105 to size. In the alternative, the plate 105 could be formed by a roll operation;

Step 2—Etch the apertures 125 in the metal plate 105;

Step 3—Attach the magnetic material 115 (which is in the form of a ferrite greensheet) to one side of etched metal plate 105;

Step 4—Punch apertures 125 in the magnetic material 115 using the etched holes in the metal plate 105 as guides;

Step 5—Repeat steps 1 to 4 for a second metal plate 110 and ferrite greensheet 120;

Step 6—Align the assembly created at step 4 with that created at step 5;

Step 7—Sinter the magnetic sandwich 100 including the magnetic material 115,120 using a conventional sintering method; and Step 8—Align the magnetic field perpendicular to the surface of the magnet 100, to magnetize the magnet assembly.

The above structure provides a steel/ferrite laminate magnet with the desired mechanical properties. Foreach half of the structure, the aperture length is typically in the range from between about 2.0×→6.0× the diameter, with the steel substrate being of the order of about 50 $\mu$m thick. For a magnet with 100 $\mu$m diameter apertures, the aperture length is approximately 400 $\mu$m, giving a magnet thickness of 500 $\mu$m and for 200 $\mu$m diameter apertures, the aperture length may increase to 1.2 mm, giving a magnet thickness of 1.3 mm. Note that these figures represent the average aperture aspect ratio. Satisfactory beam collimation will determine the minimum aperture length and maximum aperture length will be determined by manufacturing processes.

In an embodiment which uses stainless steel has the material for the plates on the outside faces of the magnet, the plates are magnetically "transparent" so as not to disturb the desired flux pattern from the magnet.

The plates also serve to maintain flatness of the magnet under mechanical loads caused by assembly, thermal cycling or by operation of a hot cathode where temperature variations can be neutralized by the thermally conductive metal.

It is possible to use metal plates with high permeability e.g. soft iron. These will have the effect of "shunting" the magnetic field external to the magnet assembly, so limiting the collimating effect of the magnetic field to the apertures only. Outside the apertures, the electron beam is then influenced only by electrostatic fields associated with normal display operation. The electron beam will still be influenced by magnetic fields generated external to the display. The permeable metal plate will not correct for high external fields, but will provide some correction.

The magnet is to be used with electron beams passing through the apertures. Despite the collimating effect of the magnetic field, there is bound to be some collision of stray electrons and positively charged ions with the aperture walls. If the magnetic material were to be a perfect insulator, electron collisions would result in the deposition of a negative charge on the aperture walls and positive ion collisions would result in the deposition of a positive charge on the aperture walls. This in turn would lead to a reduction in the potential at the walls, so disturbing the electrostatic field pattern and hence the electron beam. In the limit if sufficient charge were deposited, the potential would fall so much as to exclude any further electrons from entering the aperture and the display would cease to function until this charge was removed.

To circumvent this problem, the magnetic material has an additive which provides a high but finite resistance, typically in the range $10^7 \rightarrow 10^9\Omega/\square$. (Ohms per square) Thus there is a leakage path for the charge left by any electron collisions or any positive ion collisions with the aperture walls. However, the resistance is sufficiently high to allow the correct potential gradient across the aperture without dissipating excessive power, which would lead to possible thermal problems within the magnet itself.

Other ceramic materials (in particular, glass) are added to the base ferrite to act as a binder and to modify the thermal expansion coefficient of the ferrite/glass composite to closely match the metal plate(s). Similarly, dielectric and electrode materials should have thermal expansion coefficients near or matched to the metal plates. For the ferrite/glass composite, increasing the percentage of glass per volume decreases the final obtainable magnetic field strength. Calculation suggests that up to one-third of the ferrite may be replaced before the collimating action of the field is degraded sufficiently to cause a problem with the operation of the display. This corresponds to a magnet field, strength of about 2000 gauss. In conventional usage this percentage of binders, etc. is not required. An increase in the magnetic field strength required could be achieved with alternate materials, such as one of the rare earths, if required. A suitable rare earth material is Samarium Cobalt.

A further benefit of the laminate structure is that the steel plates on the outside of the magnet are highly electrically conductive. They thus form equipotential surfaces on each side of the magnet apertures. In so doing, a highly uniform field across the display is to be expected. Apart from the field uniformity, the etched holes in the steel plate also "shield" the magnet aperture walls from the collision of stray electrons.

Computer simulations show that the most likely place for a collision to occur is at the aperture entrance, before the full collimating effect of the magnetic field has exerting its influence. In this region, the electrons are passing through the steel layer and thus, since it is a conductor, collisions will not be a problem, manifesting itself as a negligibly small current flowing in the bottom plate.

Figure 2:
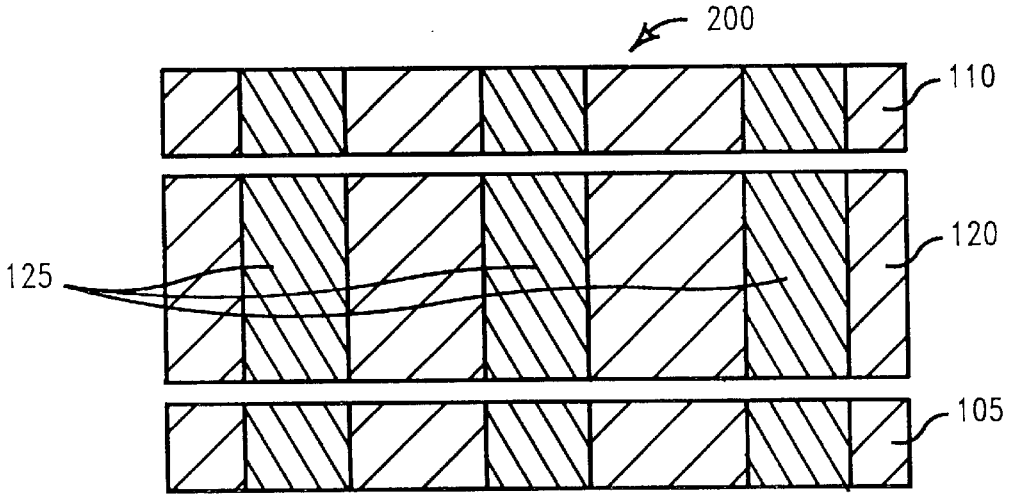
FIG. 2 shows a magnet according to a second embodiment of the present invention having a pair of metal layers with a ferrite sheet therebetween.

FIG. 2 shows a second embodiment 200 of a magnet 200 of the present invention. In this embodiment a single ferrite sheet 120 is used, together with a top metal plate 110 and a bottom metal plate 105. In this context bottom means the surface of the magnet facing the cathode or source of electrons and top means the surface of the magnet facing the phosphor screen. This embodiment does not allow the formation of such high aspect ratio apertures, but it allows for a cheaper and simpler construction. The benefits of maintaining positional accuracy of the apertures during manufacture are still achieved.

One of the differentiating features of a Magnetic Matrix Display is the mechanical simplicity of the display construction. A major contributor to this simplicity is the use of the magnet as the carrier for the grid electrodes used to operate the display.

Figure 3:
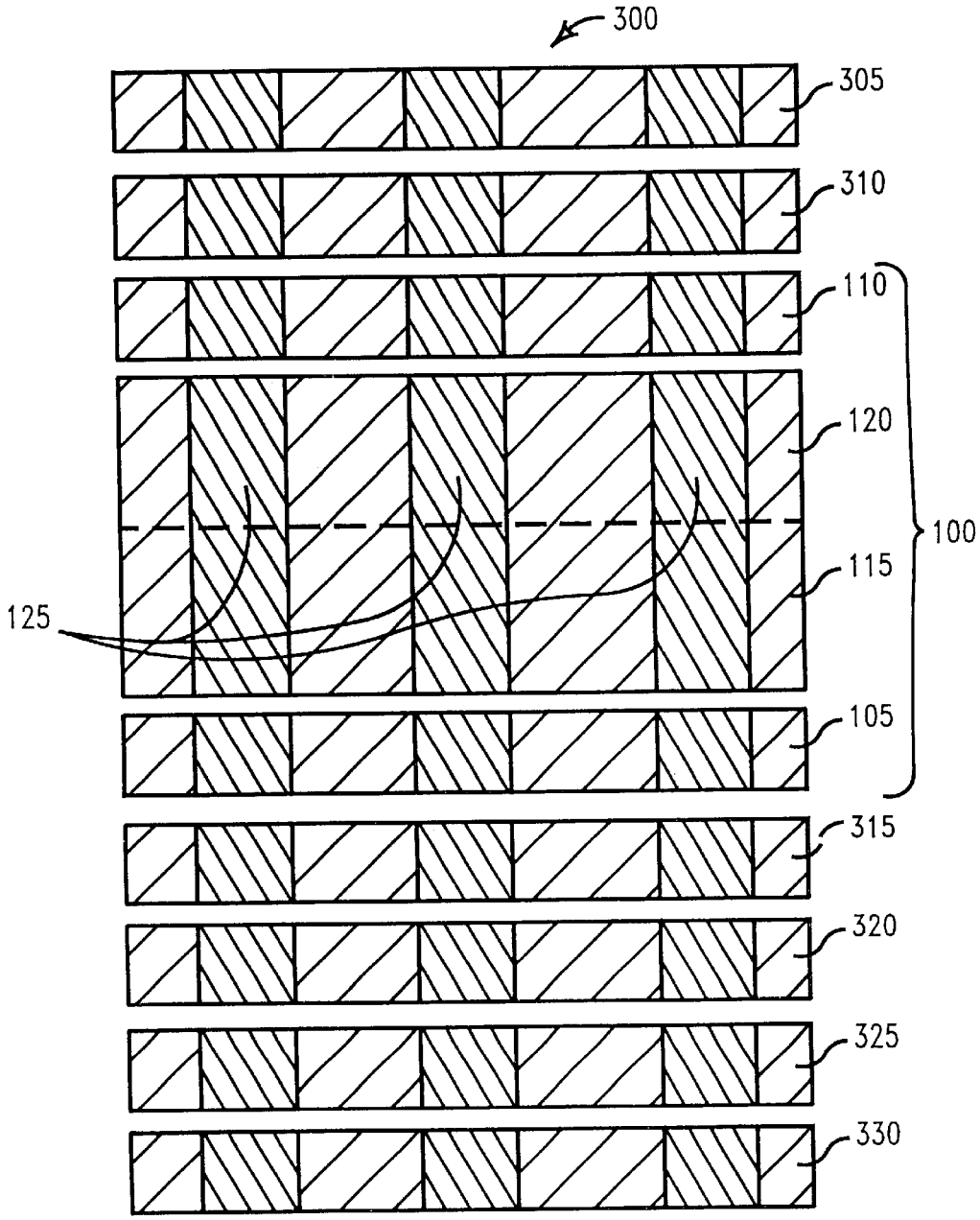
FIG. 3 shows a magnet according to a first embodiment of the present invention having deflection anodes and control electrodes formed thereon.

FIG. 3 shows a laminate magnet 300 according to the present invention. The magnet structure denoted by the reference numeral 100 corresponds to that of FIG. 1. Additionally, since the outer surfaces of the magnet assembly are highly conductive metal plates, there is a thin insulating layer 310, between the metal plate 110 and the deflection electrode 305. The deflection electrode 305 is a deflection electrode as described in UK Patent Application No. 2304981 referred to earlier in this description.

Similarly, control electrodes 320 and 330 are located on metal plate 105, being separated from the metal plate 105 by a thin insulating layer 315 and from each other by a further thin insulating layer 325.

Insulating layers 310, 315 can be an insulating layer comprising of a thin insulating glass, glass plus ceramic or metal oxide. A thin glass or glass plus ceramic is typically between about 10 to about 50 $\mu$m thick.

Insulating layer 325 could also be an insulating glass or glass plus ceramic with typical thickness 10–50 $\mu$m.

Insulating layer 325 could also be a metal with surface insulating metal oxide to provide electrical insulation.

Figure 4:
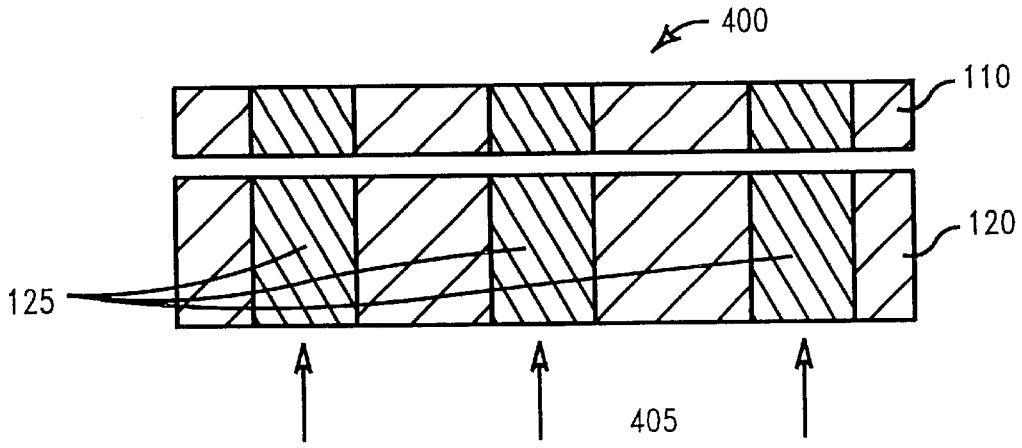
FIG. 4 shows a magnet according to a third embodiment of the present invention having a single metal layer attached to a ferrite sheet.

FIG. 4 shows a third embodiment of the magnet 400 of the present invention In this embodiment only a single metal plate 110 is used, which will reduce the overall strength compared to the first and second embodiments described in FIGS. 1 and 2 respectively, but the cost and complexity of manufacture will be reduced. The cathode or electron source is located below the magnet and the electrons enter the apertures 125 in the direction shown by arrows 405.

Figure 5:
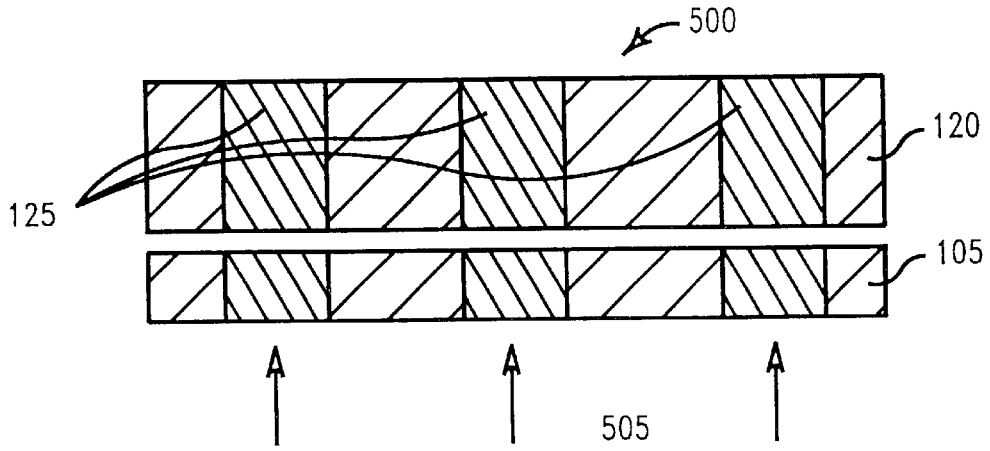
FIG. 5 shows a magnet according to a third embodiment of the present invention wherein the single metal layer faces the incoming electron beams.

FIG. 5 shows a variation of the magnet 500 of the third embodiment shown in FIG. 4, in which the single metal plate 105 is on the other side of the ferrite, that is, the plate is located on the side which faces the cathode or electron source. The electrons enter the apertures 125 in the direction shown by arrows 505.

Although an illustrative embodiment and its advantages have been described in detail hereinabove, they have been described as example and not as limitation, various changes, substitutions and alterations can be made in the illustrative embodiment without departing from the breadth, scope and spirit of the present inventions.

What is claimed is:

1. A process for making a metal/ferrite laminate magnet comprising:

(a) forming a plurality of apertures in a metal sheet, (b) securing a ferrite green sheet to a portion of said metal sheet, (c) forming a plurality of apertures in said ferrite green sheet such that at least a portion of said apertures in said ferrite green sheet are aligned with at least a portion of a corresponding aperture in said metal sheet, (d) sintering said metal sheet and said ferrite green sheet to form a metal/ferrite laminate, and (e) magnetizing said laminate to form said metal/ferrite laminate magnet.

2. The process according to claim 1, wherein said laminate magnet is magnetized in the direction of the apertures.

3. The process according to claim 1, wherein the plurality of apertures formed in said metal sheet and said ferrite green sheet are arranged as a regular array.

4. The process according to claim 3, wherein said regular array is selected from a group consisting of a square array or a rectangular array.

5. The process according to claim 1, wherein at least one aperture in said metal sheet is used as a guide to form at least one aperture in said ferrite green sheet.

6. The process according to claim 1, wherein the thermal expansion coefficient of said ferrite sheet is similar to that of said metal sheet.

7. The process according to claim 1, wherein material for said metal sheet is selected from a group consisting of soft iron or stainless steel.

8. The process according to claim 1, wherein the diameter for said aperture in said metal sheet is approximately 100 $\mu$m.

9. The process according to claim 1, wherein the thickness of said metal sheet is approximately 50 $\mu$m.

10. The process according to claim 1, wherein the diameter for said aperture in said ferrite green sheet is approximately 100 $\mu$m.

11. The process according to claim 1, wherein the thickness of said ferrite green sheet is approximately 200 $\mu$m.

12. The process according to claim 1, wherein said aperture diameter for said metal sheet and said ferrite green sheet is approximately 200 μm, said metal sheet is approximately 50 μm in thickness, and said ferrite green sheet is approximately 600 μm in thickness.

13. The process according to claim 1, wherein said ferrite sheet has a bulk electrical resistance of between $10^7$ Ω/□ (ohms per square) and $10^9$ Ω/□ (ohms per square).

14. The process according to claim 1, further comprising:

securing an insulating layer to at least a portion of said metal sheet, securing a conductive layer that will form a deflection anode to at least a portion of said insulating layer, and forming a plurality of apertures in said conductive layer and said insulating layer, such that each of said aperture correspond to, and are aligned with, a corresponding aperture in said metal sheet.

15. The process of claim 1, wherein at least two metal/ferrite laminate are formed and secured to each other prior to said sintering and magnetizing.

16. The process of claim 15, wherein ferrite green sheet from two metal/ferrite laminate are secured to each other such that at least a portion of the apertures in said ferrite green sheet are aligned with at least a portion of said apertures in said metal sheets, and wherein said two metal/ferrite laminate are sintered and magnetized.

17. The process according to claim 16, wherein said metal/ferrite laminate is magnetized in the direction of the apertures.

18. The process according to claim 16, wherein the plurality of apertures formed in said metal sheet and said ferrite sheet are arranged as a regular array.

19. The process according to claim 18, wherein said regular array is selected from a group consisting of a square array or a rectangular array.

20. The process according to claim 16, wherein at least one aperture in said metal sheet is used as a guide to form at least one aperture in said ferrite green sheet.

21. The process according to claim 16, wherein the thermal expansion coefficient of said ferrite sheet similar to that of said metal sheet.

22. The process according to claim 16, wherein material for said metal sheet is selected from a group consisting of soft iron or stainless steel.

23. The process according to claim 16, wherein the diameter for said aperture for said metal sheet is approximately 100 μm.

24. The process according to claim 16, wherein the thickness of said metal sheet is approximately 50 μm.

25. The process according to claim 16, wherein the diameter for said aperture for said ferrite green sheet is approximately 100 μm.

26. The process according to claim 16, wherein the thickness of said ferrite green sheet is approximately 200 μm.

27. The process according to claim 16, wherein said aperture diameter for said metal sheet and said ferrite green sheet is approximately 200 μm, said metal sheet is approximately 50 μm in thickness, and said ferrite green sheet is approximately 600 μm in thickness.

28. The process according to claim 16, wherein said ferrite sheet has a bulk electrical resistance of between $10^7$ Ω/□ (ohms per square) and $10^9$ Ω/□ (ohms per square).

29. The process according to claim 16, further comprising:

securing an insulating layer to at least a portion of said metal sheet, securing a conductive layer that will form a deflection anode to at least a portion of said insulating layer, and forming a plurality of apertures in said conductive layer and said insulating layer, such that each of said aperture correspond to, and are aligned with, a respective aperture in said metal sheet.

* * * * *